United States Patent [19]

Cork et al.

[11] 4,009,146

[45] Feb. 22, 1977

[54] METHOD OF AND MIXTURE FOR ALUMINIZING A METAL SURFACE

[75] Inventors: Frank Cork, Alvaston; David Frederick Bettridge, Chaddesden; Philip Charles Clarke, Derby, all of England

[73] Assignee: Rolls-Royce (1971) Limited, London, England

[22] Filed: Aug. 14, 1974

[21] Appl. No.: 497,470

[30] Foreign Application Priority Data

Sept. 19, 1973 United Kingdom ..... 44032/73
Apr. 19, 1974 United Kingdom ..... 17163/74

[52] U.S. Cl. ..... 260/42.22; 260/32.8 R; 260/33.6 UA; 427/229; 428/457

[51] Int. Cl.[2] ..... C08K 3/08

[58] Field of Search ..... 260/42.22; 427/229

[56] References Cited

UNITED STATES PATENTS

| | | | |
|---|---|---|---|
| 2,736,665 | 2/1956 | Rogers | 260/42.22 |
| 2,833,030 | 5/1958 | Peaske | 260/42.22 |
| 2,885,304 | 5/1959 | Thomson et al. | 427/229 |
| 2,941,894 | 6/1960 | McAdow | 260/42.22 |
| 3,105,056 | 9/1963 | Oshima | 260/42.22 |

*Primary Examiner*—James H. Derrington
*Attorney, Agent, or Firm*—Cushman, Darby & Cushman

[57] ABSTRACT

A coating mixture for use in aluminizing metal surfaces comprises 5 to 50% by weight of an organic resin binder, 2 to 25% by weight of one or more halides and the balance finely divided particles of an aluminium-containing alloy. The alloy has a melting point of at least 1100° C and contains 40 to 60% by weight of aluminium, the balance comprising iron, cobalt, nickel or zirconium or any combination thereof. The coating mixture is applied to the metal surface to be aluminized and then heated in an inert or reducing atmosphere at a temperature of 800° to 1100° C for a time sufficient to enable at least some of the aluminium in the alloy to diffuse into the metal surface.

7 Claims, No Drawings

METHOD OF AND MIXTURE FOR ALUMINIZING A METAL SURFACE

This invention relates to a mixture for and a method of aluminising a metal surface.

It is well known to form an aluminised layer on a metal surface by a pack aluminising technique. This technique normally involves embedding the surface to be aluminised in powdered pack aluminising mixture and then heating the mixture to a suitable temperature in a controlled atmosphere.

Such pack aluminising techniques are inconvenient as they involve the use of large quantities of expensive aluminising mixtures and specially adapted furnacing plant. Moreover such techniques are not altogether successful when large objects are aluminised, or where certain areas of objects are required to be selectively aluminised. Further problems exist when previously aluminised objects which have been damaged are repaired by re-aluminising. If only a small portion of the aluminised layer has been damaged, the whole of the layer must be removed before a new aluminised layer may be deposited. Such layer removal invariably results in a net loss of base material which could be critical in terms of mechanical properties and manufacturing tolerances.

Pack aluminising mixtures usually comprise a mixture of aluminum particles, a halide and an inert filler material. The surface to be aluminised is embedded in the mixture, whereupon the mixture is heated at a temperature high enough to cause some of the aluminium particles therein to diffuse into the surface and form an aluminised layer. It is frequently found that aluminised layers produced on surfaces having complex shapes by the use of pack aluminising mixtures are of non-uniform depth. Generally, the aluminised layer tends to be thicker in those convex regions of the surface having small radii of curvature than regions which are generally flat, concave or of a large radii of curvature. We have found for instance, that if a metal object of aerofoil cross-section is aluminised in a pack aluminising mixture, then the aluminised layer in those regions of the object having small radii of convex curvature is sometimes more than twice the depth of the aluminised layer in those regions of the object having large radii of curvature.

It is an object of the present invention to provide a method of and mixture for aluminising a metal surface which substantially avoids the aforesaid disadvantages of pack aluminising mixtures and methods.

Thus according to one aspect of the present invention, a coating mixture suitable for use in aluminising a metal surface comprises 5 to 50% by weight of an organic resin binder, 2 to 25% by weight of one or more halides and the balance finely divided particles of an alloy having a melting point of at least 1100° C and containing 40 to 60% by weight of aluminium, the balance of said alloy comprising iron, cobalt, nickel or zirconium or any combination thereof.

Said finely divided particles of said alloy are preferably between 30 and 150 microns in diameter.

Said alloy preferably contains from 54.0 to 56.5% by weight of aluminium.

Said alloy is preferably a binary alloy.

Said halide or halides in said mixture may be an ammonium halide or halides and/or a cobalt halide or halides and/or a nickel halide or halides.

According to a further aspect of the present invention, a coating mixture suitable for use in aluminising a metal surface comprises 5 to 50% by weight of an organic resin binder, 2 to 20% by weight of an ammonium halide or halides and the balance finely divided particles of an alloy containing, by weight, approximately 50% aluminium and 50% iron.

Said organic resin binder is preferably an acrylate or a polyvinyl alcohol.

Said mixture may contain one or more solvents to adjust its viscosity to that required for the particular method chosen of application of the mixture to the metal surface to be aluminised.

According to a still further aspect of the present invention, a method of aluminising a metal surface comprises the subsequent steps of:

coating the metal surface to be aluminised with at least one coat of a coating mixture as described in any preceding statement of the invention, and carrying out an aluminising heat treatment in which said coated metal surface is heated at a temperature within the range 800° to 1100° C in an inert or reducing atmosphere for a time sufficient to enable at least some of said aluminium from said alloy contained in said mixture to diffuse into said metal surface.

If said coating mixture also contains one or more solvents, the solvent or solvents are preferably evaporated off after said mixture has been coated on to said metal surface, but before said coated metal surface is subjected to said aluminising heat treatment.

Preferably when more than one coat of said coating mixture is applied to said metal surface prior to said aluminising heat treatment, the solvent in each layer is evaporated off prior to the application of the subsequent coat.

Said surface to be aluminised may comprise nickel or cobalt or iron or any alloys thereof.

Said aluminising heat treatment may be carried out for a time between half an hour to sixteen hours.

Said inert atmosphere may comprise argon.

Said reducing atmosphere may comprise hydrogen.

Coating mixtures in accordance with the present invention may be applied to the surface to be aluminised by the conventional methods of brushing, dipping or spraying. Thus it will be seen that by using such methods of application, localised areas of the surface may be readily aluminised without elaborate masking. Moreover when an already aluminised metal surface has been damaged and part of the aluminised layer has been lost, the aluminised layer may be repaired by the localised application of a coating mixture in accordance with the present invention, followed by heat treatment in accordance with the method of the present invention, thereby avoiding the need to realuminise the whole surface.

We believe that in methods of aluminising in accordance with the present invention, aluminium is supplied to the surface to be aluminised predominantly by the mechanism described below, although we do not wish to be bound by this theory of this mechanism.

As the metal surface coated with a coating mixture in accordance with the present invention is heated up to a temperature within the range 800°–1100° C, the organic resin binder contained in the mixture burns or evaporates off. The halide or halides remaining then react with the aluminium present in the alloy particles to form a volatile aluminium halide or halides. The volatile halide or halides, coming into contact with the metal surface, decompose to deposit aluminium on the surface. The thus deposited aluminium then diffuses into the metal surface to form an aluminised layer i.e. a layer which includes an alloy consisting of aluminium and the constituent metal or metals of the metal surface. We have found that diffusion of the other constituent of the alloy particles into the metal surface is minimal.

It will be seen therefore that the predominant mechanism of aluminising methods and mixtures in accordance with the present invention is different from that of prior art pack aluminising methods and mixtures in which the predominant mechanism is the direct diffusion of the aluminium particles contained in the aluminising mixture into the surface being aluminised.

In aluminising methods and mixtures in accordance with the present invention, the amount of aluminium available for diffusion into the surface being aluminised is directly dependent on the amount of halide or halides present in the mixture. This is in contradistinction to methods of aluminising using pack aluminising mixtures where the amount of aluminium available for diffusion into the surface being aluminised is directly dependent on the concentration of aluminium particles in the aluminising mixture in the vicinity of the surface being aluminised. It will be seen therefore that as, in aluminising methods and mixtures in accordance with the present invention, aluminium is available in the vicinity of the surface to be aluminised in the form of a volatalised aluminium halide or halides, a more even distribution of aluminium deposition can be achieved than is usually the case with prior art pack aluminising methods and mixtures. In practice, we have found that aluminised coatings produced in accordance with the method of the present invention are distinguished from aluminised coatings produced in accordance with prior art pack aluminising methods of aluminising by their substantially constant depth, even across surfaces of complex geometrical shape.

The following examples will serve to illustrate the present invention:

EXAMPLE 1

An aluminising mixture of the following composition was made up and thoroughly mixed so as to achieve a substantially even distribution of its constituents:

| | |
|---|---|
| 40% v/v solution of polybutyl methacrylate in xylene | - 200 grams |
| Particles of an alloy containing by weight 55% aluminium and 45% cobalt, varying in size from 30 to 150 microns diameter and substantially grease free | - 770 grams |
| Ammonium Chloride | - 150 grams |
| Xylene - to produce required viscosity - see below | |

Xylene was added to the aluminising mixture until the mixture was of sufficient viscosity to produce a coating, when dry, of 0.025 inches to 0.075 inches on a flat test panel. Such a method of determining the viscosity of the aluminising mixture was necessary as the desired viscosity was too high to be measured on conventional viscosity measuring devices such as flow cups.

A gas turbine engine turbine blade manufactured from the nickel base alloy known as Nimonic 108 (Nimonic is a Registered Trade Mark) and having the following nominal constituents, by weight:

| | | |
|---|---|---|
| Carbon | : | 0.15% |
| Silicon | : | 1.0% |
| Copper | : | 0.2% |
| Iron | : | 1.0% |
| Manganese | : | 1.0% |
| Chromium | : | 14.0 - 15.7% |
| Titanium | : | 0.9 - 1.5% |
| Aluminium | : | 4.5 - 4.9% |
| Cobalt | : | 18 - 22% |
| Molybdenum | : | 4.5 - 5.5% |
| Lead | : | 0.0025% |
| Balance | : | Nickel plus impurities |

was prepared by abrasive blasting with 120–220 mesh aluminium oxide grit, pressure cleaning with compressed air to remove dust particles and degreasing in trichloroethylene vapour.

The blade was immersed in the aluminising mixture and then withdrawn therefrom at a controlled rate of 8 inches per minute. The coated blade was allowed to air dry for thirty minutes to allow the solvent to evaporate before being immersed in and withdrawn from the aluminising mixture in a similar manner as before for a second time. The second coat was again allowed to air dry but for a period of one hour.

The thus coated blade was then heated in argon to a temperature of 1000° C and maintained at that temperature for a period of one and a half hours. The blade was then allowed to cool in argon.

Any excess aluminising mixture was removed from the blade by the use of a bristle brush followed by immersion of the blade in a boiling 5% aqueous solution of citric acid.

The blade was then sectioned in order to examine the resultant aluminised coating. The coating was found to consist of two layers: an inner layer consisting of a mixture of complex carbides of the metal of the blade, and an outer aluminide layer. The aluminide and carbide layers together varied in thickness from 0.0016 inches to 0.0022 inches. The carbide layer alone was found to be 0.0003 inches thick.

EXAMPLE 2

An aluminising mixture identical to that described in Example 1 was made up.

A gas turbine engine turbine blade manufactured from the nickel based alloy known as Nimonic 118 (Nimonic is a Registered Trade Mark) and having the following nominal constituents by weight:

| | | |
|---|---|---|
| Carbon | : | 0.2% |
| Silicon | : | 1.0% |
| Copper | : | 0.2% |
| Iron | : | 1.0% |
| Manganese | : | 1.0% |
| Chromium | : | 14-16% |
| Titanium | : | 3.5-5.5% |
| Aluminium | : | 4.5-5.5% |
| Cobalt | : | 13—17% |
| Molybdenum | : | 3.0-5.0% |
| Lead | : | 0.0025% |
| Balance | : | Nickel plus impurities |

was prepared as in the previous example.

The blade was immersed in the aluminising mixture and then withdrawn therefrom at a controlled rate of 8 inches per minute. The coated blade was allowed to air dry for thirty minutes before being immersed in and withdrawn from the aluminising mixture in a similar manner as before for a second time. The second coat was allowed to air dry but for a period of one hour.

The coated blade was then heated in argon to a temperature of 950° C and maintained at that temperature for one and a half hours. The blade was then allowed to cool in argon.

Any excess aluminising mixture was removed from the blade by the use of a bristle brush followed by immersion of the blade in a boiling 5% aqueous solution of citric acid.

The blade was then sectioned in order to examine the resultant aluminised coating. The coating was found to consist of two layers: an inner layer consisting of a mixture of complex carbides of the metal of the blade and an outer aluminide layer. The aluminide layer and carbide layers together varied in thickness from 0.0010 to 0.0015 inches. The carbide layer alone was found to be 0.0001 inches thick.

EXAMPLE 3

An aluminising mixture of the following composition was made up and thoroughly mixed so as to achieve a substantially even distribution of its constituents:

| | |
|---|---|
| 40% solution of polymethyl methacrylate in xylene | - 90 grams |
| Ferroaluminium powder (50% Al 50% Fe) 150 microns diameter (grease free granular) | - 225 grams |
| Ammonium Chloride | 0.25 grams |
| Methylcyclohexanone - | sufficient to produce a viscosity of approximately 40 seconds through a B4 at 20° C |

A gas turbine engine turbine blade manufactured from the nickel base alloy known as Nimonic 105 (Nimonic is a Registered Trade Mark) and having the following constituents by weight:

| | | |
|---|---|---|
| Carbon | : | 0.2% |
| Silicon | : | 1.0% |
| Copper | : | 0.5% |
| Iron | : | 2.0% |
| Manganese | : | 1.0% |
| Chromium | : | 13.5 to 15.75% |
| Titanium | : | 0.9 to 1.5% |
| Aluminium | : | 4.5 to 4.9% |
| Cobalt | : | 18% to 22% |
| Molybdenum | : | 4.5 to 5.5% |
| Lead | : | 0.005 |
| Balance | : | Nickel plus impurities |

was prepared by abrasive blasting with 120–220 mesh aluminium oxide grit, pressure cleaned with compressed air to remove dust particles and finally degreased in trichloroethylene vapour.

The blade was then coated with two coats of the aluminising mixture by dipping. The first coat was allowed to air dry for 30 minutes before the application of the second coat.

After the second coat had been allowed to air dry for 30 minutes, the blade was heated to a temperature of 870° C in argon, and maintained at that temperature for a period of six hours.

After being allowed to cool in argon, the blade was examined and found to have an aluminide/carbide layer 0.0006 to 0.0014 inches thick deposited thereon. The carbide layer alone was found to be 0.00015 to 0.0004 inches thick.

EXAMPLE 4

A gas turbine engine turbine blade similar to that used in example 3 was cleaned and coated with two coats of the aluminising mixture used in example 3 in the same manner as described in that example. The first coat was allowed to air dry for 30 minutes before the application of the second coat.

After allowing the second coat to air dry for 30 minutes, the blade was heated to a temperature of 1030° C in argon. The blade was maintained at that temperature for a period of three hours.

After being allowed to cool in argon, the blade was examined and found to have aluminide/carbide layer 0.001 to 0.0016 inches thick deposited thereon. The carbide layer alone was found to be 0.00025 to 0.0004 inches thick.

EXAMPLE 5

A gas turbine engine turbine blade similar to that used in example 3 was cleaned and coated with two coats of the aluminising mixture used in example 3 in the same manner as described in that example. The first coat was allowed to air dry for 30 minutes before the application of the second coat.

After allowing the second coat to air dry for 30 minutes, the blade was heated to a temperature of 1100° C in argon and held at that temperature for two hours.

After being allowed to cool in argon, the blade was examined and found to have an aluminide/carbide layer 0.001 to 0.0014 inches thick deposited thereon. The carbide layer alone was found to be 0.0003 to 0.0005 inches thick.

We have found that the aluminide layer of coatings produced in accordance with the method and mixture of the present invention on nickel base alloys correspond to the comparatively ductile hyper-stoichiometric (NiAl) aluminide composition containing in the region of 35–40% by weight of aluminium.

In general, we have found that the higher the temperature at which the diffusion treatment is carried out, the greater the resultant thickness of the carbide layer becomes. Moreover we have found that higher diffusion temperatures result in lower aluminium concentrations in the aluminide layer.

Although the present invention has been described with reference to nickel base alloy surfaces it will be appreciated that other metal surfaces, such as iron or cobalt based surfaces, could be aluminised by methods and mixtures in accordance with the present invention.

We claim:

1. A coating mixture suitable for use in aluminizing a metal surface comprising 5 to 50% by weight of an organic resin binder evaporatable at high temperatures, 2 to 25% by weight of one or more inorganic halides and the balance being finely divided particles of an alloy having a melting point of at least 1100° C, said alloy containing 40 to 60% by weight of aluminum, the balance of said alloy comprising one or more metals selected from the group consisting of iron, cobalt, nickel and zirconium, and at least one solvent to adjust the viscosity of the coating mixture to that required for the particular method chosen of application of the mixture to the metal surface to be aluminized, the coating mixture providing, in use, a reaction with the inorganic halide or halides with the aluminum forming volatilized aluminum halide in the vicinity of the coated metal surface to be aluminized and providing a substantially uniform aluminized layer deposited on the metal surface.

2. A coating mixture as claimed in claim 1 wherein said finely divided particles of said alloy are between 30 and 150 microns in diameter.

3. A coating mixture as claimed in claim 2 wherein said alloy contains from 54.0 to 56.5% by weight of aluminium.

4. A coating mixture as claimed in claim 1 wherein said alloy is a binary alloy.

5. A coating mixture as claimed in claim 1 wherein said inorganic halide in said mixture is or are selected from the group comprising an ammonium halide or halides, a cobalt halide or halides and a nickel halide or halides.

6. A coating mixture as claimed in claim 1 wherein said organic resin binder is selected from the group consisting of polyacrylates and polyvinyl alcohols.

7. A coating mixture suitable for use in aluminising a metal surface comprising 5 to 50% by weight of an organic resin binder, 2 to 20% by weight of an ammonium inorganic halide or halides and the balance finely divided particles of an alloy containing, by weight, approximately 50% aluminium and 50% iron.

* * * * *